US010046433B2

(12) United States Patent
Kuehne et al.

(10) Patent No.: US 10,046,433 B2
(45) **Date of Patent: *Aug. 14, 2018**

(54) HANDLE ARRANGEMENT FOR SANDER

(71) Applicant: BLACK & DECKER INC., New Britain, CT (US)

(72) Inventors: Brent A. Kuehne, Red Lion, PA (US); David Miller, Baltimore, MD (US)

(73) Assignee: BLACK & DECKER INC., New Britain, CT (US)

( * ) Notice: Subject to any disclaimer, the term of this patent is extended or adjusted under 35 U.S.C. 154(b) by 120 days.

This patent is subject to a terminal disclaimer.

(21) Appl. No.: 15/177,740

(22) Filed: Jun. 9, 2016

(65) Prior Publication Data

US 2016/0288292 A1 Oct. 6, 2016

Related U.S. Application Data

(63) Continuation of application No. 14/509,451, filed on Oct. 8, 2014, now Pat. No. 9,387,578.

(60) Provisional application No. 61/896,266, filed on Oct. 28, 2013.

(51) Int. Cl.

| | |
|---|---|
| ***B24B 41/02*** | (2006.01) |
| ***B25F 5/02*** | (2006.01) |
| ***B24B 23/02*** | (2006.01) |

(52) U.S. Cl.

CPC ..... *B24B 41/02* (2013.01); *B24B 23/02* (2013.01); *B25F 5/02* (2013.01)

(58) Field of Classification Search

CPC ..... B24B 41/02; B24B 23/02
USPC ..... 451/359
See application file for complete search history.

(56) References Cited

U.S. PATENT DOCUMENTS

| | | | | |
|---|---|---|---|---|
| D221,926 | S | 9/1971 | Farkas | |
| 3,732,651 | A | 5/1973 | Rodstein | |
| 4,005,502 | A | 2/1977 | Stevens (Boyer) et al. | |
| 4,625,462 | A | 12/1986 | Fushiya et al. | |
| 4,967,516 | A | 11/1990 | Hoshino | |
| 5,319,889 | A * | 6/1994 | Rudolf | B24B 55/105 451/359 |

(Continued)

FOREIGN PATENT DOCUMENTS

| | | | |
|---|---|---|---|
| DE | 102013225885 | A1 | 6/2015 |
| FR | 2992245 | A1 | 12/2013 |

(Continued)

*Primary Examiner* — George Nguyen

(74) *Attorney, Agent, or Firm* — Stephen R. Valancius

(57) ABSTRACT

An improved handle arrangement is provided for a power tool, such as a sander. The sander may include: a housing; a primary handle extending in a rearward direction away from an upper rear portion of the housing; a secondary handle positioned at an upper front portion of the housing, where the secondary handle is formed as a knob protruding in a forward direction which is opposite the rearward direction; a platen coupled to a lower portion of the housing; and a motor assembly disposed within the housing. A groove may be formed into an exterior surface of the housing along an intermediate portion of the housing, such that the intermediate portion extends between the primary handle and the secondary handle and the groove extends from a top surface of the housing towards a lower portion portion of the housing along opposing side surfaces of the housing.

20 Claims, 5 Drawing Sheets

(56) References Cited

U.S. PATENT DOCUMENTS 5,551,114 A 9/1996 Lee
D384,261 S 9/1997 Hayakawa et al.
5,697,115 A 12/1997 Sciarra et al.
5,706,541 A 1/1998 Gutelius et al.
5,718,014 A 2/1998 deBlois et al.
D413,242 S 8/1999 Robson
5,956,792 A 9/1999 Gutelius et al.
5,978,999 A 11/1999 deBlois et al.
D418,263 S 12/1999 Rees
6,004,194 A * 12/1999 Hild ..... B24B 45/006 451/344
6,131,231 A 10/2000 Huang
6,179,696 B1 1/2001 Duffy
D441,268 S 5/2001 Heun
6,248,007 B1 6/2001 deBlois et al.
6,253,405 B1 7/2001 Gutelius et al.
D447,397 S 9/2001 Netzler
D448,264 S 9/2001 Lee
D465,713 S 11/2002 Keller
D467,151 S 12/2002 Ho
D470,737 S 2/2003 Chunn et al.
D471,329 S 3/2003 Heun
6,626,746 B2 9/2003 Mayr
D482,254 S 11/2003 Tsuzuki et al.
D488,978 S 4/2004 Cheung
D491,034 S 6/2004 Evans
D496,574 S 9/2004 Sakai et al.
6,910,960 B2 6/2005 Reich
6,951,046 B2 10/2005 Robinson
D513,951 S 1/2006 Chung et al.
D514,910 S 2/2006 Nagasaka et al.
D525,752 S 7/2006 Bakker
D527,239 S 8/2006 Baumgaertner
D528,387 S 9/2006 Robson
D531,000 S 10/2006 Meyers et al.
7,115,172 B1 10/2006 Teodorovich
D534,323 S 12/2006 Hong
D538,490 S 3/2007 Hong
D539,109 S 3/2007 Aglassinger
D548,901 S 8/2007 Hong
7,291,061 B2 11/2007 Kiss
7,291,062 B2 11/2007 Kiss et al.
7,313,838 B2 1/2008 Long et al.
D560,990 S 2/2008 Aglassinger
RE40,345 E 5/2008 Duffy
D578,365 S 10/2008 Mandel et al.
7,485,026 B2 2/2009 King
7,516,508 B2 4/2009 Stackpole, Jr. et al.
D592,477 S 5/2009 Wright
D592,926 S 5/2009 Aglassinger
7,534,165 B2 * 5/2009 Milbourne ..... B24B 23/00 451/259
7,536,743 B2 5/2009 Goh et al.
7,565,712 B2 7/2009 Long et al.
D597,392 S 8/2009 Meyers et al.
D600,085 S 9/2009 Mandel et al.
D605,488 S 12/2009 Aglassinger
D610,888 S 3/2010 Izumisawa et al.
7,731,571 B2 6/2010 Fukinuki et al.
7,771,253 B2 * 8/2010 Wuensch ..... B24B 23/04 451/344
D636,244 S 4/2011 Keller
8,105,132 B2 * 1/2012 Roehm ..... B24B 23/03 451/353
8,172,642 B2 5/2012 King et al.
8,192,254 B2 6/2012 Fukinuki et al.
8,281,874 B2 10/2012 Imada et al.
8,727,838 B2 5/2014 Leung
9,061,393 B2 6/2015 Sugita et al.
9,114,500 B2 8/2015 Sugita et al.
2001/0004580 A1 6/2001 Legner
2002/0065027 A1 5/2002 Mayr
2003/0228833 A1 12/2003 Boyer
2004/0058632 A1 3/2004 Boyer
2005/0138777 A1 6/2005 Cornfield
2005/0153637 A1 7/2005 Jahson
2006/0003679 A1 1/2006 Dineen
2007/0131439 A1 6/2007 Hashimoto et al.
2009/0239451 A1 9/2009 Geiser
2010/0197209 A1 8/2010 Dehde
2011/0003541 A1 1/2011 Liu
2011/0214302 A1 9/2011 Inayoshi
2012/0080205 A1 4/2012 Chen
2013/0196571 A1 8/2013 King et al.
2014/0057539 A1 2/2014 Breitenmoser
2014/0327215 A1 11/2014 Thorson et al.
2014/0357165 A1 12/2014 Elen
2015/0083450 A1 3/2015 Sperl et al.
2015/0118945 A1 4/2015 Kuehne
2016/0193713 A1 * 7/2016 Takeda ..... B24B 23/028 451/359
2017/0173824 A1 * 6/2017 Sergyeyenko ..... B28D 1/047

FOREIGN PATENT DOCUMENTS

GB 1340656 A 12/1973
GB 2423492 A 8/2006
JP 2009166147 A 7/2009
WO WO 2005039823 A1 * 5/2005 ..... B24B 23/02

* cited by examiner

HANDLE ARRANGEMENT FOR SANDER

CROSS-REFERENCE TO RELATED APPLICATIONS

This application claims the benefit of U.S. Provisional Application No. 61/896,266, filed on Oct. 28, 2013, and U.S. application Ser. No. 14/509,451 filed Oct. 8, 2014. The entire disclosure of the above applications are incorporated herein by reference.

FIELD

The present disclosure relates to an improved handle arrangement for a power tool.

BACKGROUND

Electric power tools, such as sanding tools, utilize housings which include a gripping surface or handle. The handle enables the user to manipulate the power tool for its intended purpose. Sanding tools have been provided for various uses. For instance, drywall sanding tools have been provided for sanding joints between panels of drywall after the joints have been filled and taped.

During operation of a power tool, the user typically holds the handle and moves the housing, including a head assembly, over a working surface (e.g., a sanding surface). Positioning the head assembly relative to the working surface can be awkward and cumbersome. Some electric power tools, including power sanding tools, utilize more than one gripping surface or handle to improve the user's ability to position the housing and head assembly relative to the working surface.

In order to improve the performance of sanding tools and other electric power tools, it may be desirable to have an improved gripping surface or handle.

This section provides background information related to the present disclosure which is not necessarily prior art.

SUMMARY

This section provides a general summary of the disclosure, and is not a comprehensive disclosure of its full scope or all of its features.

An improved handle arrangement is provided for a power tool, such as a sander. The sander may include: a housing; a primary handle extending in a rearward direction away from an upper rear portion of the housing; a secondary handle positioned at an upper front portion of the housing, where the secondary handle is formed as a knob protruding in a forward direction which is opposite the rearward direction; a platen coupled to a lower portion of the housing; and a motor assembly disposed within the housing and drivably coupled to the platen.

In one aspect of this disclosure, a groove is formed into an exterior surface of the housing along an intermediate portion of the housing, such that the intermediate portion extends between the primary handle and the secondary handle and the groove extends from a top surface of the housing towards a lower portion portion of the housing along opposing side surfaces of the housing.

In another aspect of this disclosure, a switch is disposed in the primary handle between the motor assembly and a distal end of the primary handle. The switch is electrically connected between the motor assembly and the distal end of the primary handle; and a switch member is disposed on an exterior surface of the primary handle and operable to actuate the switch.

In yet another aspect of this disclosure, the platen forms a point in the forward direction, such that the point extends in the forward direction a distance beyond a front surface of the secondary handle, thereby providing a clearance for a user's hand grasping the secondary handle.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
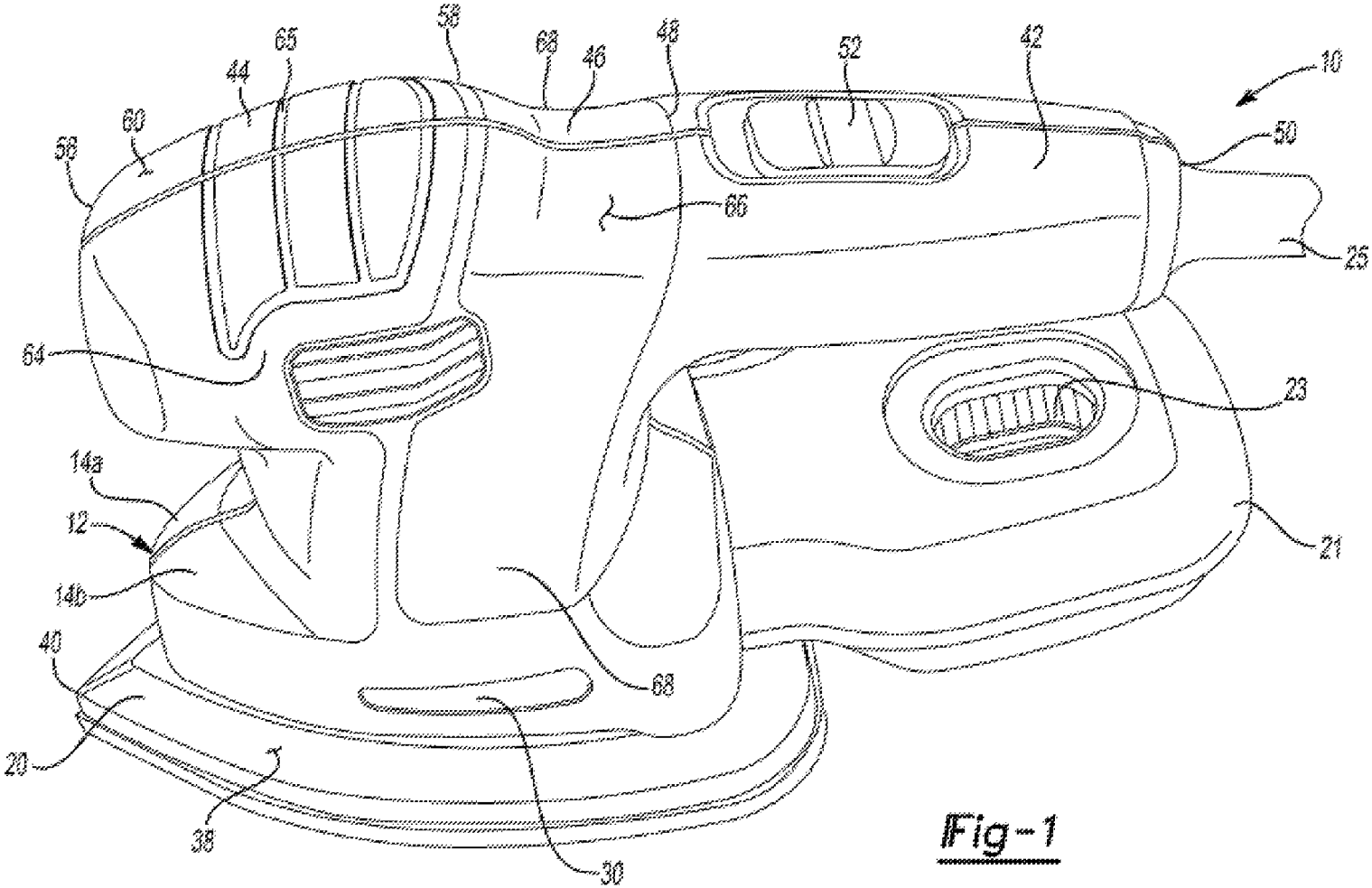
FIG. 1 is a perspective view of a power tool including an improved handle in accordance with the principles of the present disclosure.

Example embodiments will now be described more fully with reference to the accompanying drawings.

With reference to the figures, a power tool in accordance with the present disclosure is illustrated and designated with the reference numeral 10. The power tool 10 will be described in the context of a power sander and will be referred to as sander 10; however, it should be understood that the sander 10 can be other types of power tools such as a drill, screwdriver, rotary tool, clippers, saw or the like.

The sander 10 includes a tool body or housing 12 having a pair of clam shell portions 14*a* and 14*b*, a power system 16, a drive system 18 that is housed in a cavity 19 defined by the clam shell portions 14*a* and 14*b*, a sanding platen 20, and a dust collection unit or chamber 21 to which dust can be extracted from air that is drawn through a dust extraction port (not shown) formed in the housing 12. In the example embodiment, the sanding platen 20 is and driven by the drive system 18. The dust collection chamber 21 may further include a filter 23 for removing dust and other debris from the air. In one embodiment, the dust collection chamber 21 may be removed from the dust extraction port and replaced with a vacuum hose to collect the dust. The vacuum hose may connect directly to the dust extraction port or, alternatively, an adapter may be used to accommodate the vacuum hose if it is a different size or shape than the dust extraction port. For example, if the dust extraction port is oblong, an adapter may have an oblong end to connect to the dust extraction port and a circular shaped end for connecting to a vacuum hose so that the vacuum hose can work with the dust extraction port even if they are not the same shape or size.

Figure 2:
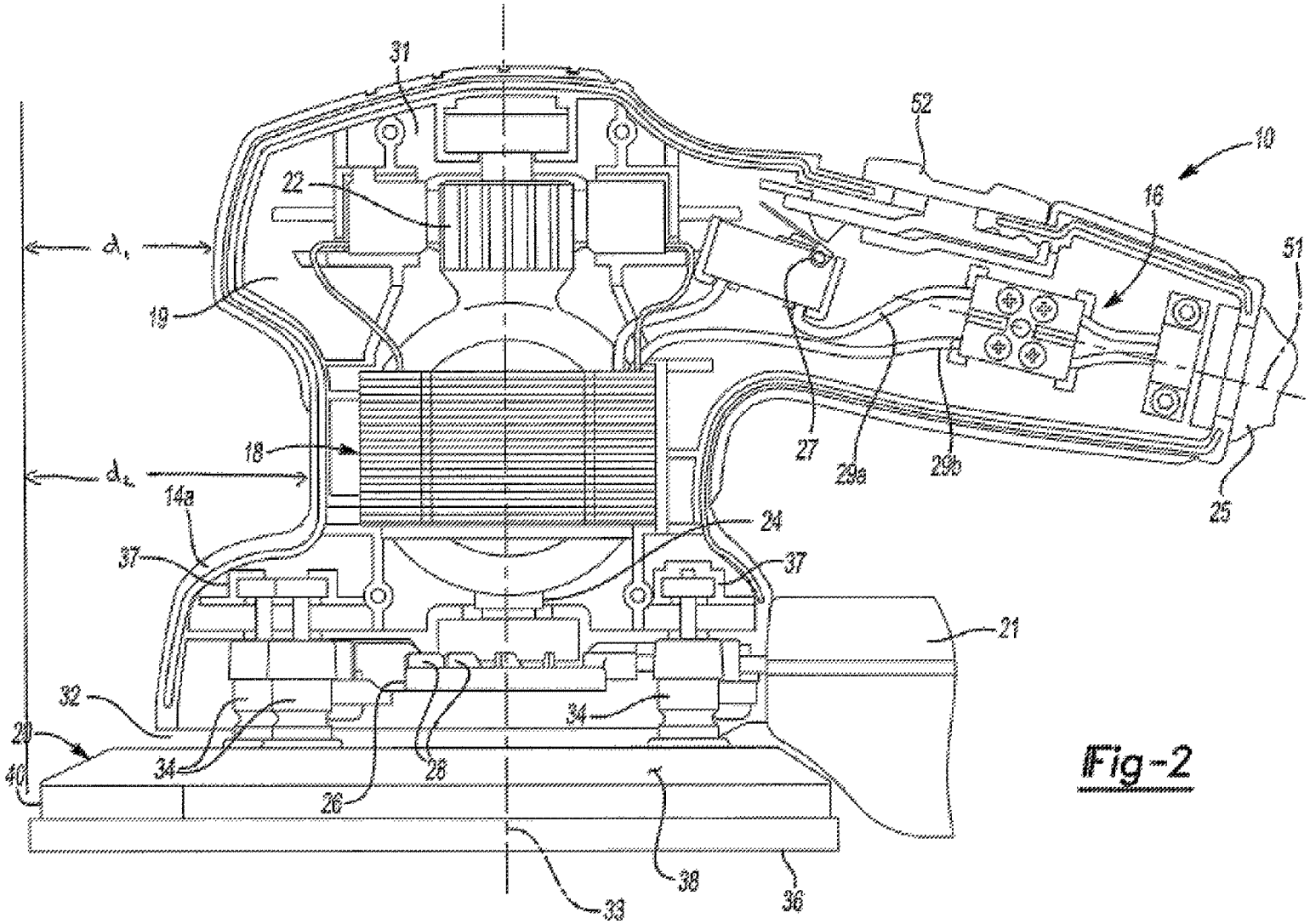
FIG. 2 is a partial cut-away view of the power tool of FIG. 1.

With particular reference to FIG. 2, the power system 16 can include a power cord 25 and a switch 27. The power cord 25 can include a first lead 29*a* and a second lead 29*b*. The first lead 29*a* is in communication with the switch 27. In the example embodiment, the power cord 25 and the switch 27 are coupled to the clam shell portion 14*a* of the housing 12. In this manner, the first and second leads 29*a*, 29*b* can be directly extended to the drive system 18, without extending between the drive system 18 and an upper portion 31 (relative to the view in FIG. 2) of the housing 12, to reduce the height H of the sander 10 and the housing 12. It is appreciated that while the sander 10 is shown operatively associated with a power cord 25 for alternating current (AC) operation, the sander 10 can also be configured for operation with other power sources, such as direct current (DC) or a pneumatic input.

The drive system 18 can include an electric motor 22 mounted within the housing 12 and having an output shaft 24 for rotation about an axis 33. A fan 26 can be mounted on the output shaft 24 for rotation therewith. The fan 26 can include a plurality of upwardly projecting blades 28. The blades 28 can be generally arranged to draw air in from at least one opening 30 in the housing and/or from an opening 32 between the housing 12 and the sanding platen 20, and direct the air toward the motor 22. In this manner, the upwardly projecting fan blades 28 can operate to generate a cooling airflow when the motor 22 is turned on to help cool the motor 22 during operation of the sander 10. A bearing (not shown) can be eccentrically located radially with respect to the output shaft 24. The sanding platen 20 can be operably secured to the output shaft 24. In the example embodiment, the output shaft 24 and the axis 33 extend substantially perpendicularly from the sanding platen 20. It will also be appreciated that the output shaft 24 and the axis 33 may extend from the sanding platen 20 at various angles and directions. The bearing, can cause an orbital movement of the sanding platen 20 in response to driving rotation of the output shaft 24. It is appreciated that while the particular example described is an orbital sander, the present teachings may be similarly applied to other sander tools such as random orbital sanders and belt sanders for example.

The sanding platen 20 can be fixed to a lower portion of the housing 12 by a series of legs 34. In the example shown, four legs 34 are used; two toward the front of the sander 10 and a pair disposed toward the rear of the sander 10. The legs 34 may have an elastomeric construct to improve the movement of the sanding platen 20 relative to the housing 12. The legs 34 can be fixed between the sanding platen 20 and the housing 12. A corresponding series of clamping flanges 37 can be formed in the housing 12 for capturing first ends of the legs 34. Second ends of the legs 34 can be fixedly secured to the sanding platen 20 by mounting rings (not shown). Other configurations may be employed for securing the legs 34 between the housing 12 and the sanding platen 20, including a releasable engagement of either the first or the second ends of the legs 34 by the housing 12 or the sanding platen 20, respectively, such the sanding platen 20 is releasably connected to the housing 12.

The sanding platen 20 can be formed in any desired manner. In the particular example provided, the sanding platen 20 has a substantially flat bottom surface 36, a curved upper surface 38 and a peripheral edge with a point 40 that provides the sanding platen 20 with a substantially triangular shape. The point 40 can be used for sanding corners or other detained areas. An abrasive sheet (not shown) can be applied to the flat bottom surface by way of a hook and loop fabric fastener e.g., Velcro®. An underside of the abrasive sheet can have a first Velcro surface which can be attachable to a second Velcro surface (not shown) provided on the flat bottom surface 36 of the sanding platen 20.

Figure 4:
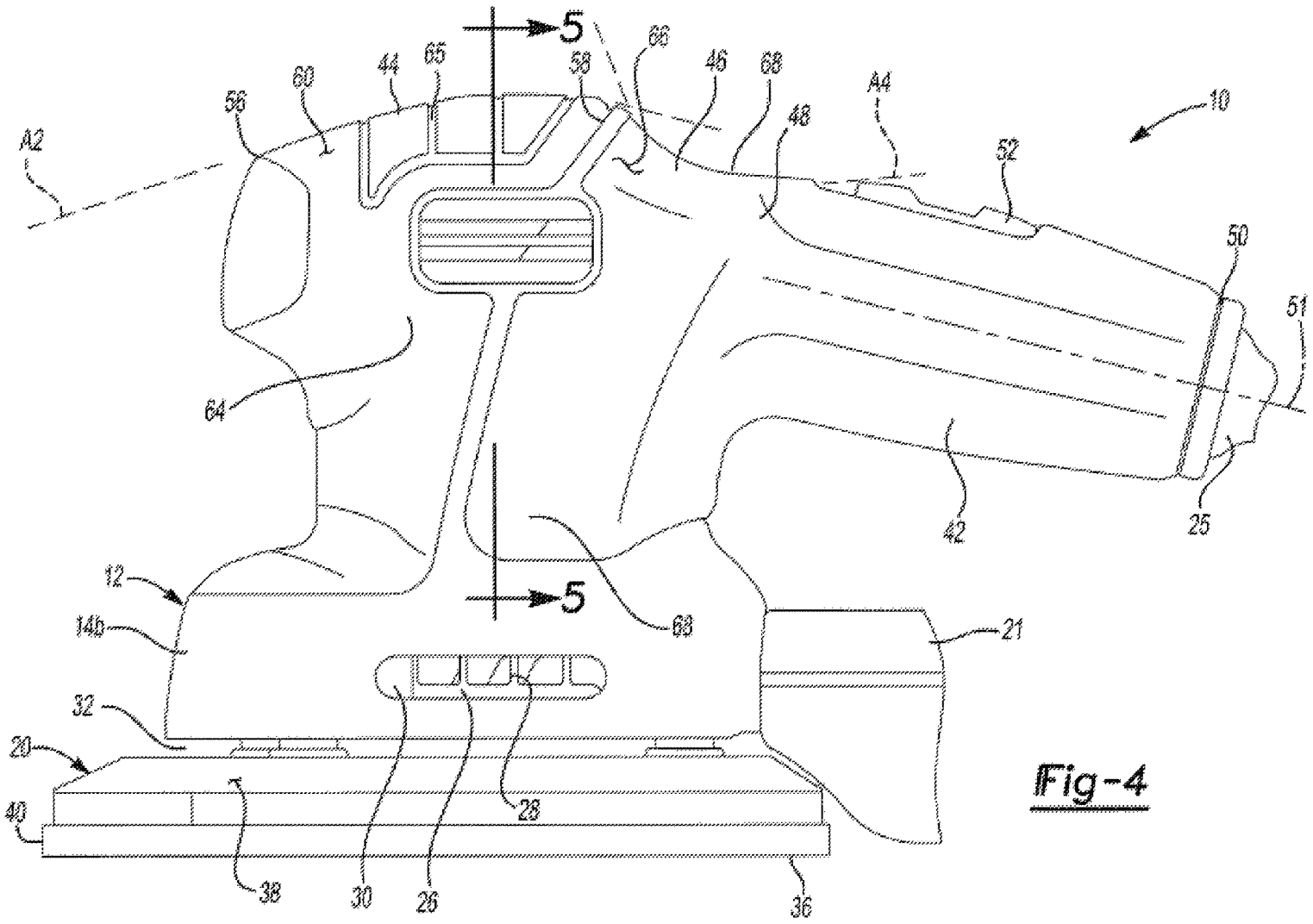
FIG. 4 is a side view of the power tool of FIG. 1.

With particular reference to FIGS. 1 and 4, in the example embodiment, an upper portion of the housing 12 may serve as, or include, a second or secondary handle portion 44 and a third or intermediate handle portion 46. In the example embodiment, the secondary and intermediate handle portions 44, 46 are integrally formed with the housing 12 using an overmold process. In another configuration, the secondary and intermediate handle portions 44, 46 may be coupled to the housing 12 with an adhesive, mechanical fasteners (e.g., clips, screws, bolts, etc.), or other suitable fastening technique. In yet another configuration, the secondary and/or intermediate handle portions 44, 46 may be integrally or monolithically formed with the housing 12.

A primary handle portion 42 may extend in a rearward direction away from an upper rear portion of the housing 12 and is configured to be grasped by a user's hand. The primary handle portion 42 may be formed from a rigid plastic material, from a rubberized or flexible material, or from any other suitable material. In the example embodiment, the primary handle portion 42 extends from, and is integrally formed with, the intermediate handle portion 46. In other configurations, the primary handle portion 42 may be a separate component that is coupled to the housing 12 with mechanical fasteners, a press-fit construct, or any other suitable fastening technique.

Figure 3:
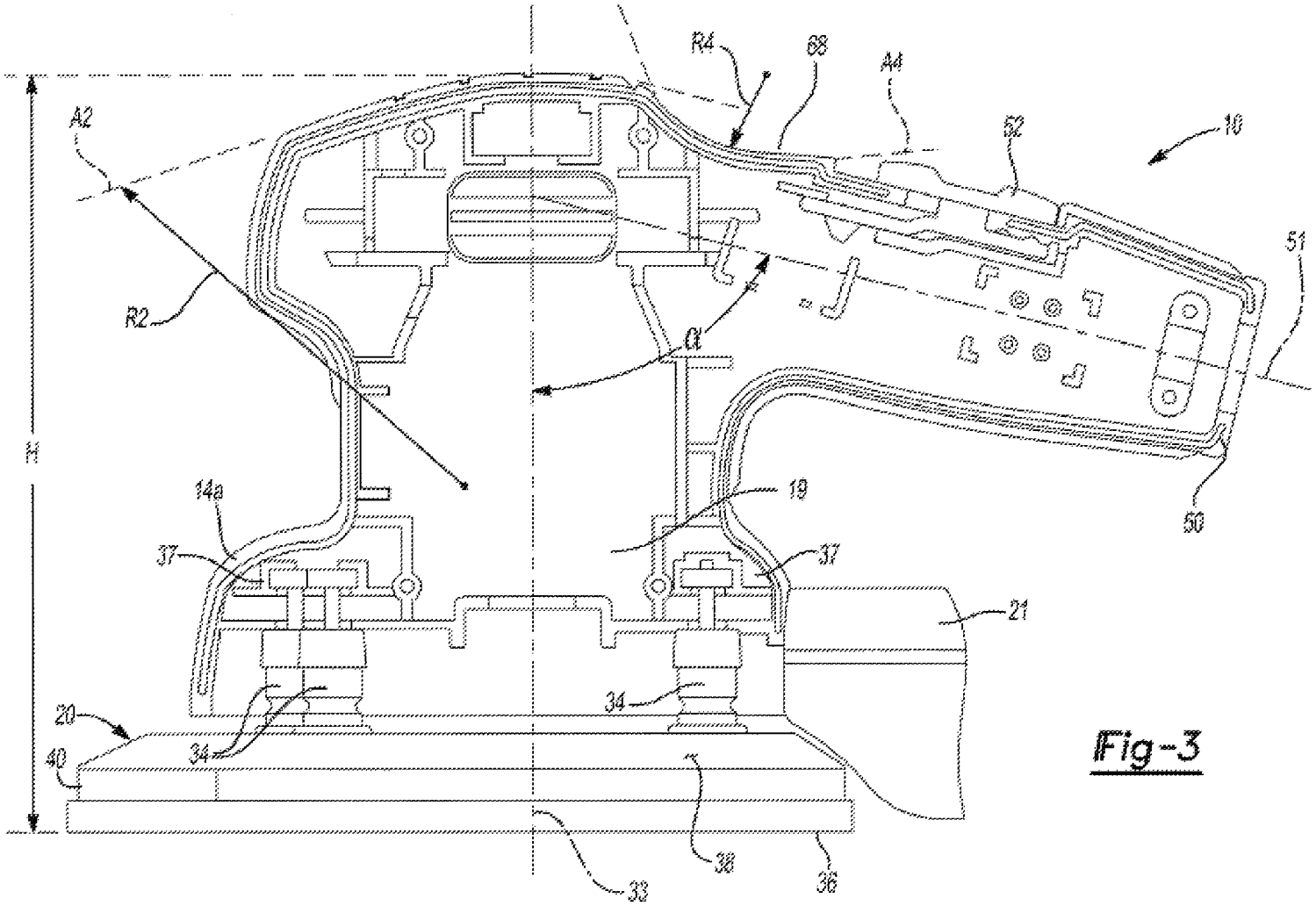
FIG. 3 is a side view of a clam shell portion of a housing of the power tool of FIG. 1.

As illustrated, in the example embodiment the primary handle portion 42 is substantially cylindrical and extends from the housing 12 in a first direction between a proximal end 48 and a distal end 50 along an axis 51. The first direction may form a non-orthogonal angle $\alpha$ with the axis 33 (FIG. 3). The angle $\alpha$ may be between 75 degrees and 89 degrees. In the example embodiment, the angle $\alpha$ is substantially equal to 85 degrees. In other embodiments, the angle $\alpha$ may be greater than or equal to 90 degrees. The primary handle portion also includes a switch member 52. In the example embodiment, the switch member 52 is coupled to an upper surface of the shell portion 14*a*. In other embodiments, the switch member 52 may be coupled to other surfaces of the shell portion 14*a*, including a lower surface of the primary handle portion 42, generally opposite the upper surface. The switch member 52 may be operable to provide electricity to the sander 10 by actuating the switch 27 to power at least the drive system 18. In the example embodiment, the switch member 52 is moveable in the first direction along the shell portion 14*a*.

With continued reference to FIGS. 1 and 4, the secondary handle is positioned at an upper front portion of the housing and is formed as a knob protruding in the forward direction. In this example embodiment, the secondary handle portion 44 extends between a proximal end 56 and a distal end 58. The secondary handle portion 44 includes an arcuate or curved upper surface 60 and a plurality of ribs or ridge portions 65 protruding from the surface 60.

Figure 5:
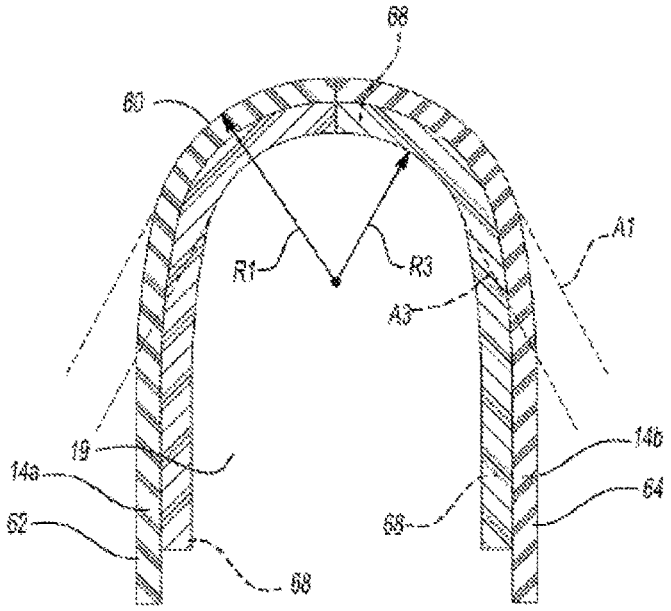
FIG. 5 is a cross-sectional view of a housing of the power tool of FIG. 1, taken along the Line 5-5 of FIG. 4.

With reference to FIG. 5, the surface 60 may define a first arc A1 extending from and between a first lateral side 62 of the housing 12 and a second lateral side 64 of the housing 12. With reference to FIGS. 3 and 4, the surface 60 may also define a second arc A2 extending from and between the proximal end 56 of the secondary handle portion 44 and the distal end 58 of the secondary handle portion 44. In the example embodiment, first and second arcs A1, A2 are concave relative to the cavity 19 of the housing 12. The first arc A1 includes a first radius of curvature R1 and the second arc A2 includes a second radius of curvature R2. In the example embodiment, the second radius of curvature R2 is greater than the first radius of curvature R1. Each ridge portion 65 may be substantially parallel to an adjacent ridge portion 65 and extend arcuately from and between the first lateral side 62 of the housing 12 and the second lateral side 64 of the housing. The ridge portions 65 may allow a user to securely grasp the secondary handle portion 44 and improve the maneuverability of the sander 10 over a working surface (not shown).

In the example embodiment, the point 40 of the platen extends in the forward direction a distance ($d_1$) beyond the front surface of the secondary handle as indicated in FIG. 2. That is, the proximal end 56 of the secondary handle portion 44 may be offset from the point 40 of the platen 20 in a direction substantially perpendicular to the axis 33 by a distance between twenty millimeters and fifty millimeters. In the example embodiment, the distance is on the order of thirty (30) millimeters. The offset between the proximal end 56 of the secondary handle portion 44 and the point 40 of the platen 20 will allow a user to place the point 40 of the platen 20 adjacent to a vertical wall or other obstruction (not shown) and grasp the secondary handle portion 44 without the user's hand contacting the obstruction. The protruding knob of the secondary handle portion 44 forms a recess area in the front surface of the housing where the fingers of the user's hand may reside when grasping the secondary handle 44. In the example embodiment, the distance ($d_2$) from the front surface of the housing in the recess area to the axis 33 is on the order of 46 millimeters. It is readily understood that the dimensions are provided for illustration purposes and may varying depending on the application.

With reference to FIGS. 1 and 4, a groove 68 may be formed into an exterior surface of the housing along an intermediate portion 46 of the housing, such that the groove 68 extends from a top surface of the housing towards a lower portion portion of the housing along opposing side surfaces of the housing. More specifically, the intermediate handle portion 46 may extend between the proximal end 48 of the primary handle portion 42 and the distal end 58 of the secondary handle portion 44 along the axis 51. In the example embodiment, the intermediate handle portion 46 includes an arcuate or curved upper surface 66. With reference to FIG. 5, the surface 66 may define a third arc A3 extending from and between the first lateral side 62 of the housing 12 and the second lateral side 64 of the housing. With reference to FIGS. 3 and 4, the surface 66 may also define fourth arc A4 extending from and between the proximal end 48 of the primary handle portion 42 and the distal end 58 of the secondary handle portion 44. In the example embodiment, the third arc A3 is concave relative to the cavity 19 and the fourth arc A4 is convex relative to the cavity 19. Accordingly, in the example embodiment, the surface 66 of the intermediate handle portion 46 forms a groove or recess 68 between the primary handle portion 42 and the secondary handle portion 44. The third arc A3 includes a third radius of curvature R3 and the fourth arc A4 includes a fourth radius of curvature R4. In the example embodiment, the fourth radius of curvature R4 is greater than the third radius of curvature R3.

The surface 66 may be substantially saddle-shaped such that the recess 68 extends from the upper portion of the housing 12 to the lower portion of the housing 12 and from the first lateral side 62 of the housing to the second lateral side 64 of the housing. The surface 66 of the intermediate handle portion 46 and the surface 60 of the secondary handle portion 44 may define a substantially S-shaped configuration.

During operation of the sander 10, or other power tool, the user may place one hand on the primary handle portion 42 and another hand on the housing 12, including the secondary handle portion 44. The angle $\alpha$ formed by the axis 51 of the primary handle portion 42, the arcs A1, A2 formed by the secondary handle portion 44, and the recess 68 formed by the arcs A3, A4 of the intermediate handle portion 46, can help the user manipulate and maneuver the sander 10 over the working surface. The intermediate handle portion 42, including the recess 68 can also improve the ergonomics and operability of the sander 10 by providing a location for a portion of the user's hand (e.g., a thumb) for gripping and/or manipulating the sander 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A sander comprising:

a housing;

a platen coupled to a lower portion of the housing, the platen having a peripheral edge with a point, the point defining a front end of the platen and the sander; and a motor assembly disposed within the housing and drivably coupled to the platen;

a grip handle positioned at an upper front portion of the housing, the grip handle formed as a knob protruding in a forward direction which is toward the front end of the sander and opposite a rearward direction;

a groove formed into an exterior surface of the housing, the groove being located rearwardly of the grip handle and continuously extending from a top surface of the housing towards a lower portion of the housing along opposing side surfaces of the housing and extending sufficiently towards the lower portion of the housing such that part of the groove is located in a lower half of the housing.

2. The sander of claim 1 further comprising:

a switch disposed in the housing, the switch being electrically connected between the motor assembly and a power source to selectively connect and disconnect the motor assembly from the power source;

a user operable switch member disposed along the exterior surface of the housing and operable to actuate the switch.

3. The sander of claim 1 wherein the groove defines a concave surface in the forward direction and a third convex surface in an upward direction substantially perpendicular to the forward direction.

4. The sander of claim 3 wherein the concave surface includes a first radius of curvature and the third convex surface includes a second radius of curvature, and wherein the first radius of curvature is greater than the second radius of curvature.

5. The sander of claim 1 wherein the grip handle defining a first convex surface in the forward direction and a second convex surface in an upward direction substantially perpendicular to the forward direction.

6. The sander of claim 5 wherein the first convex surface defines a first radius of curvature and the second convex surface defines a second radius of curvature, and wherein the first radius of curvature is greater than the second radius of curvature.

7. The sander of claim 1 wherein the platen is substantially triangularly shaped.

8. The sander of claim 1 wherein the motor assembly has an output shaft rotatable about an axis of rotation and the axis of rotation is aligned substantially perpendicular in relation to the platen.

9. The sander of claim 1, wherein the platen is fixed to a lower portion of the housing by a plurality of legs.

10. The sander of claim 9, wherein the plurality of legs comprises at least four legs.

11. The sander of claim 1, further comprising a fan which is driven by the motor.

12. The sander of claim 2, wherein the groove defines a concave surface in the forward direction and a third convex surface in an upward direction substantially perpendicular to the forward direction.

13. The sander of claim 12, wherein the concave surface includes a first radius of curvature and the third convex surface includes a second radius of curvature, and wherein the first radius of curvature is greater than the second radius of curvature.

14. The sander of claim 13, wherein the motor assembly has an output shaft rotatable about an axis of rotation and the axis of rotation is aligned substantially perpendicular in relation to the platen.

15. The sander of claim 2, wherein the grip handle defining a first convex surface in the forward direction and a second convex surface in an upward direction substantially perpendicular to the forward direction.

16. The sander of claim 15, wherein the first convex surface defines a first radius of curvature and the second convex surface defines a second radius of curvature, and wherein the first radius of curvature is greater than the second radius of curvature.

17. The sander of claim 16, wherein the motor assembly has an output shaft rotatable about an axis of rotation and the axis of rotation is aligned substantially perpendicular in relation to the platen.

18. The sander of claim 17, wherein the platen is fixed to a lower portion of the housing by a plurality of legs.

19. The sander of claim 8, wherein the plurality of legs comprises at least four legs.

20. The sander of claim 19, further comprising a fan which is driven by the motor.

* * * * *